US007301112B1

(12) United States Patent
Tsai

(10) Patent No.: US 7,301,112 B1
(45) Date of Patent: Nov. 27, 2007

(54) ILLUMINATING KEYBOARD

(76) Inventor: Huo-Lu Tsai, No. 188-1, Jhongjheng Rd., Shangfeng Village, Daya Hsiang, Taichung Hsien (TW)

( * ) Notice: Subject to any disclaimer, the term of this patent is extended or adjusted under 35 U.S.C. 154(b) by 0 days.

(21) Appl. No.: 11/586,276

(22) Filed: Oct. 25, 2006

(51) Int. Cl.
*H01H 9/18* (2006.01)

(52) U.S. Cl. ..... 200/310; 200/314; 200/317

(58) Field of Classification Search ..... 200/310–317, 200/344; 341/20, 22; 345/156, 168–170; 400/472, 489

See application file for complete search history.

(56) References Cited

U.S. PATENT DOCUMENTS 4,060,703 A * 11/1977 Everett, Jr. ..... 200/5 A
5,521,345 A * 5/1996 Wulc ..... 200/317
6,545,232 B1 * 4/2003 Huo-Lu ..... 200/5 A
6,554,442 B2 * 4/2003 Chou ..... 362/85
6,648,530 B2 * 11/2003 Kamei et al. ..... 400/472
6,743,993 B1 * 6/2004 Clark et al. ..... 200/314
6,860,612 B2 * 3/2005 Chiang et al. ..... 362/29
6,987,466 B1 * 1/2006 Welch et al. ..... 341/22
7,057,125 B1 * 6/2006 Tsai ..... 200/310
7,154,059 B2 * 12/2006 Chou ..... 200/314
7,214,897 B2 * 5/2007 Chuang ..... 200/317

* cited by examiner

*Primary Examiner*—Michael A Friedhofer
(74) *Attorney, Agent, or Firm*—Charles E. Baxley

(57) ABSTRACT

An illuminating keyboard includes an illumination device mounted between the assembly board and the base. The illumination device is composed of a circuit board, two light emitting diodes on top of the circuit board and respectively having thereon an encapsulation and a light tube having two ends respectively connected to a corresponding one of the two light emitting diodes so that light from the two light emitting diodes is able to emit through the assembly board, the thin film circuit board and the plastic plate to light keys on top of the plastic plate.

10 Claims, 5 Drawing Sheets

ILLUMINATING KEYBOARD

BACKGROUND OF THE INVENTION

1. Field of the Invention

The present invention relates to an illuminating keyboard, and more particularly to an illuminating keyboard having an illuminating device mounted inside the keyboard assembly to emit light to keys on top of the keyboard assembly such that users are able to see clearly the keys in a dark environment.

2. Description of the Prior Art

Providing light to a keyboard assembly is already available on the market. As shown in FIG. 7, the current available technology for providing light to the keyboard assembly is shown. From the depiction of FIG. 7, it is noted that a keyboard assembly normally is composed of an assembly board (80), a thin film circuit board (83), a plastic plate (84), a light enhancing plate (85), an illuminator positioning plate (86) and a base (87).

The assembly board (80) has multiple through holes (800), a pair of first supporting ledges (81) formed on a side face of each of the through holes (800) and a pair of second supporting ledges (82) formed on a side face of each of the through holes (800) and opposite to each pair of first supporting ledges (81). The thin film circuit board (83) has multiple pressing points (831) corresponding to and responsive to keys (not shown) of the keyboard assembly. The plastic plate (84) has multiple key supports (841) supporting a corresponding one of the keys and aligned with a corresponding one of the pressing points (831). The light enhancing plate (85) has a light reflection area (851) formed thereon. The illuminator positioning plate (86) has an illuminator (851) positioned on a top face of the illuminator positioning plate (86).

When the keyboard assembly is assembled, the pair of first supporting ledges (81) and of second supporting ledges (82) extend through the thin film circuit board (83) and the plastic plate (84) to have a pivotal connection to a bracket (not shown). Each key is mounted on top of the corresponding key support (841) and connected to the bracket, such that each key is able to rock due to the provision of the bracket and resume to its original position due to the provision of the key supports (841).

When the keyboard assembly is in use, the light from the illuminator (861) projects first to the light enhancing plate (85) and then the light is projected to the keys to allow the user to see clearly each of the keys in a dark environment.

Although the structural arrangement of the keyboard assembly does provides illumination to the user to facilitate the application of the keys in an environment where light is insufficient, the manufacture cost of this kind of keyboard assembly is high and a lot of sophisticated efforts is required to complete the assembly.

To overcome the shortcomings, the present invention tends to provide an improved illuminating keyboard to mitigate the aforementioned problems.

SUMMARY OF THE INVENTION

The primary objective of the present invention is to provide an illuminating keyboard having an illuminating device to provide illumination to allow a user to see clearly the keys.

Other objects, advantages and novel features of the invention will become more apparent from the following detailed description when taken in conjunction with the accompanying drawings.

DETAILED DESCRIPTION OF THE PREFERRED EMBODIMENT

Figure 1:
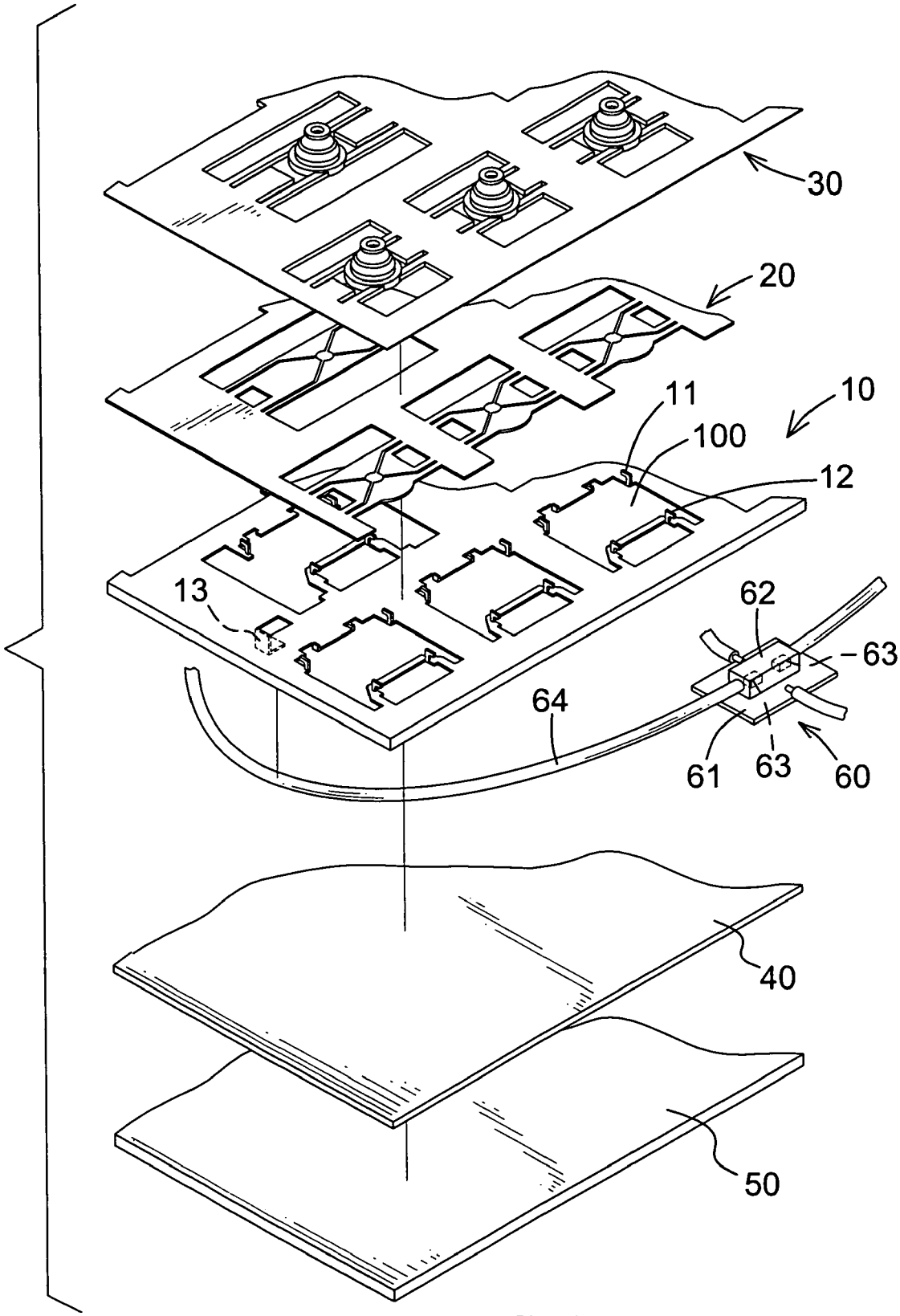
FIG. 1 is an exploded perspective view of the keyboard assembly of the present invention.

With reference to FIG. 1, it is noted that the keyboard assembly in accordance with the present invention includes an assembly board (10), a thin film circuit board (20), a plastic plate (30), a base (40) and a light enhancing plate (50). An illumination device (60) is also provided to the keyboard assembly.

The assembly board (10) has multiple through holes (100), a pair of first supporting ledges (11) formed on a side face of each of the through holes (100) and a pair of second supporting ledges (12) formed on a side face of each of the through holes (100) and opposite to each pair of first supporting ledges (11). The thin film circuit board (20) has multiple pressing points (21) corresponding to and responsive to keys (not shown) of the keyboard assembly. The plastic plate (30) has multiple key supports (31) supporting a corresponding one of the keys and aligned with a corresponding one of the pressing points (21). The base (40) is securely attached to a bottom face of the assembly board (10) and the light enhancing plate (50) is securely attached to a bottom face of the base (40). In order to provide sufficient light to illuminate keys (not shown) on top of the plastic plate (30), the illumination device (60) is placed directly under the assembly board (10). The illumination device (60) has a circuit board (61), multiple light emitting diodes (LEDs) (63) (two are shown in this preferred embodiment), an encapsulation (62) enclosing the LEDs (63) and a transparent light tube (64) having two free ends respectively connected to the two LEDs (63). The light tube (64) is treaded with a process to allow a bottom face thereof to have an opaque layer to prevent any loss of light from the bottom face of the light tube (64) such that when the two LEDs (63) are lit, light travelling through the entire light tube (64) is able to emit directly from a top face of the light tube (64).

Figure 2:
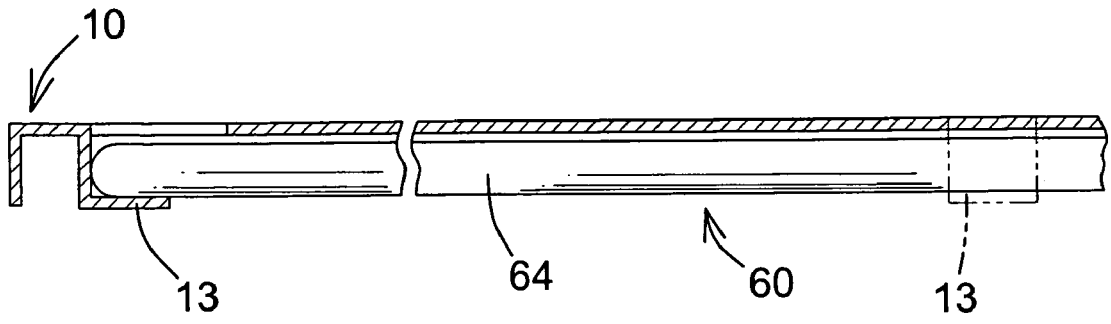
FIG. 2 is a schematic side plan view showing a positioning element is mounted at a bottom face of the assembly board.
Figure 3:
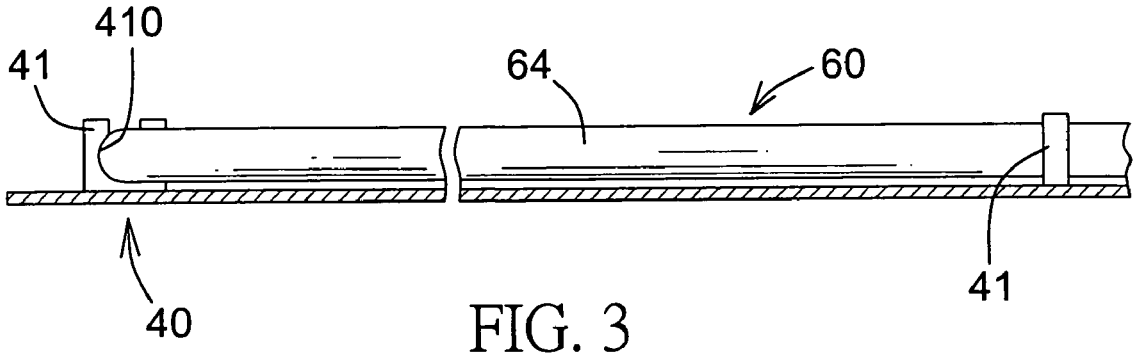
FIG. 3 is a schematic side plan view showing that a different embodiment of the positioning element is mounted on a top face of the base.

From FIGS. 1 and 2, the illumination device (60) is provided under the assembly board (10). In order to secure the attachment of the illumination device (60) to the bottom face of the assembly board (10), a positioning element (13) is formed on the bottom face of the assembly board (10). The positioning element (13) is composed of a pair of L shaped hooks mutually facing each other such that the light tube (64) is able to be received and clamped by the two hooks.

Figure 4:
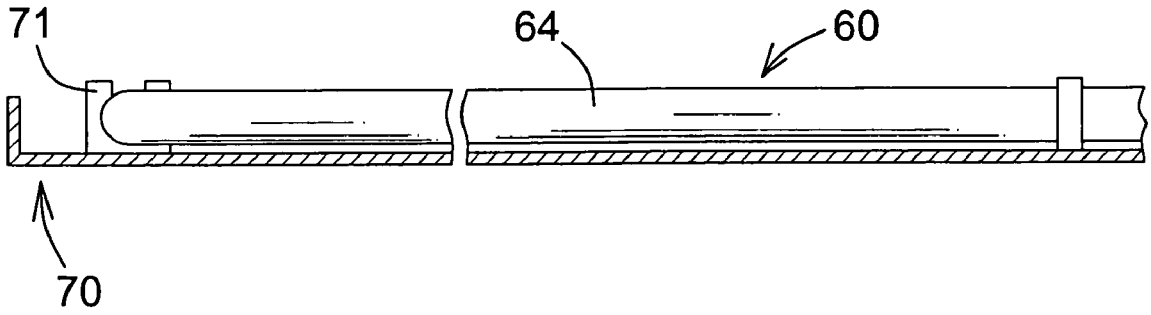
FIG. 4 is a schematic side plan view showing that an alternate embodiment of the positioning element is mounted on top of a desktop keyboard base.

With reference to FIG. 4, it is noted that the positioning element may be formed on top of the base (40). The positioning element is composed of a pair of positioning ledges (41) mutually facing each other and each positioning ledge (41) has an arcuate cutout (410) defined in a side face thereof such that the combination of the two arcuate cutouts (410) of the two positioning ledges (41) defines a receiving space for securely receiving therein the light tube (64). Each positioning ledge (41) may also be formed into L shaped hooks as shown in FIG. 2 and still the light tube (64) is positioned inside the receiving space between the two oppositely located yet mutually facing positioning ledges (41). The above description applies to laptop computers. Yet, the present invention may also be employed in desktop computers.

With reference to FIG. 4, multiple positioning elements (71) may be formed on top of a base (70) to hold the light tube (64) in position.

Figure 5:
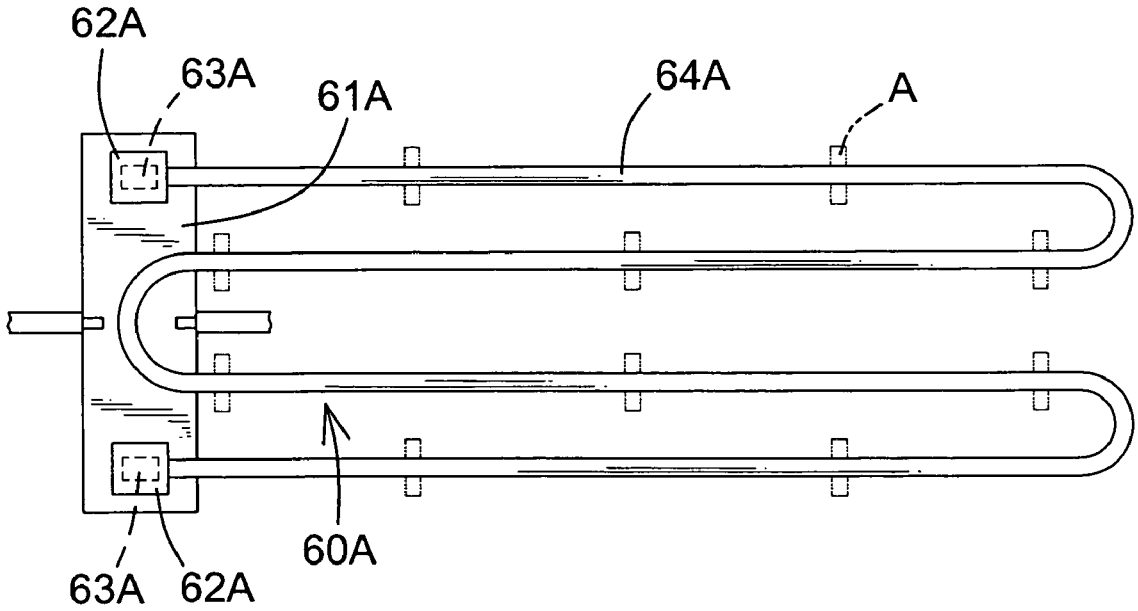
FIG. 5 is a schematic top plan view showing a different embodiment of the illumination device.

There is no limitation to the shape of the light tube (64). The shape of the light tube (64) may be circular as shown in FIG. 1 and may have turns as shown in FIG. 5. The light tube (64A) is secured by the positioning elements (A) and connected to each of the two LEDs (63A) on top of the circuit board (61A). The two LEDs (63A) respectively have the encapsulation (62A) enclosing the corresponding LED (63A).

Figure 6:
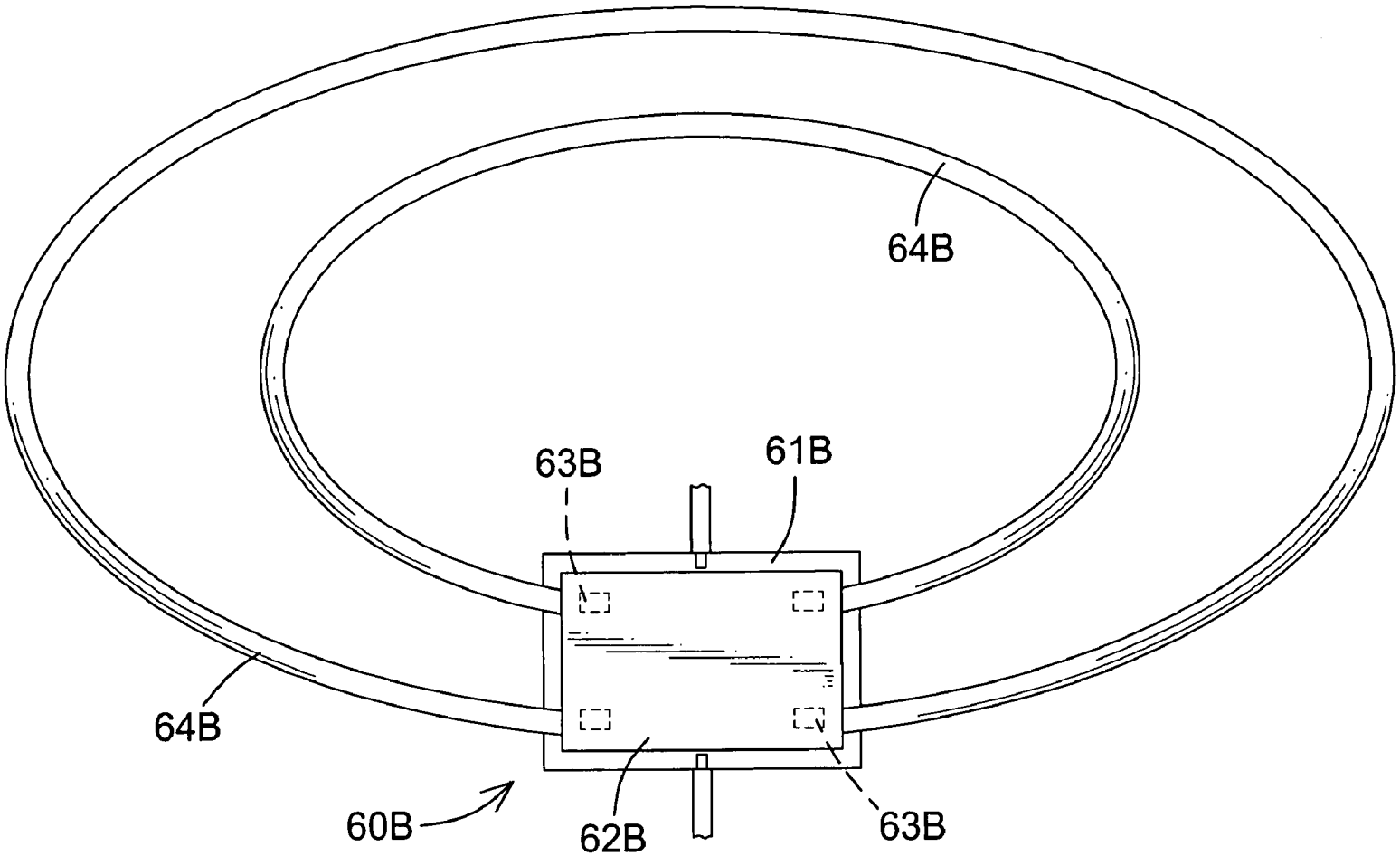
FIG. 6 is a schematic top plan view showing still a different embodiment of the illumination device.
Figure 7:
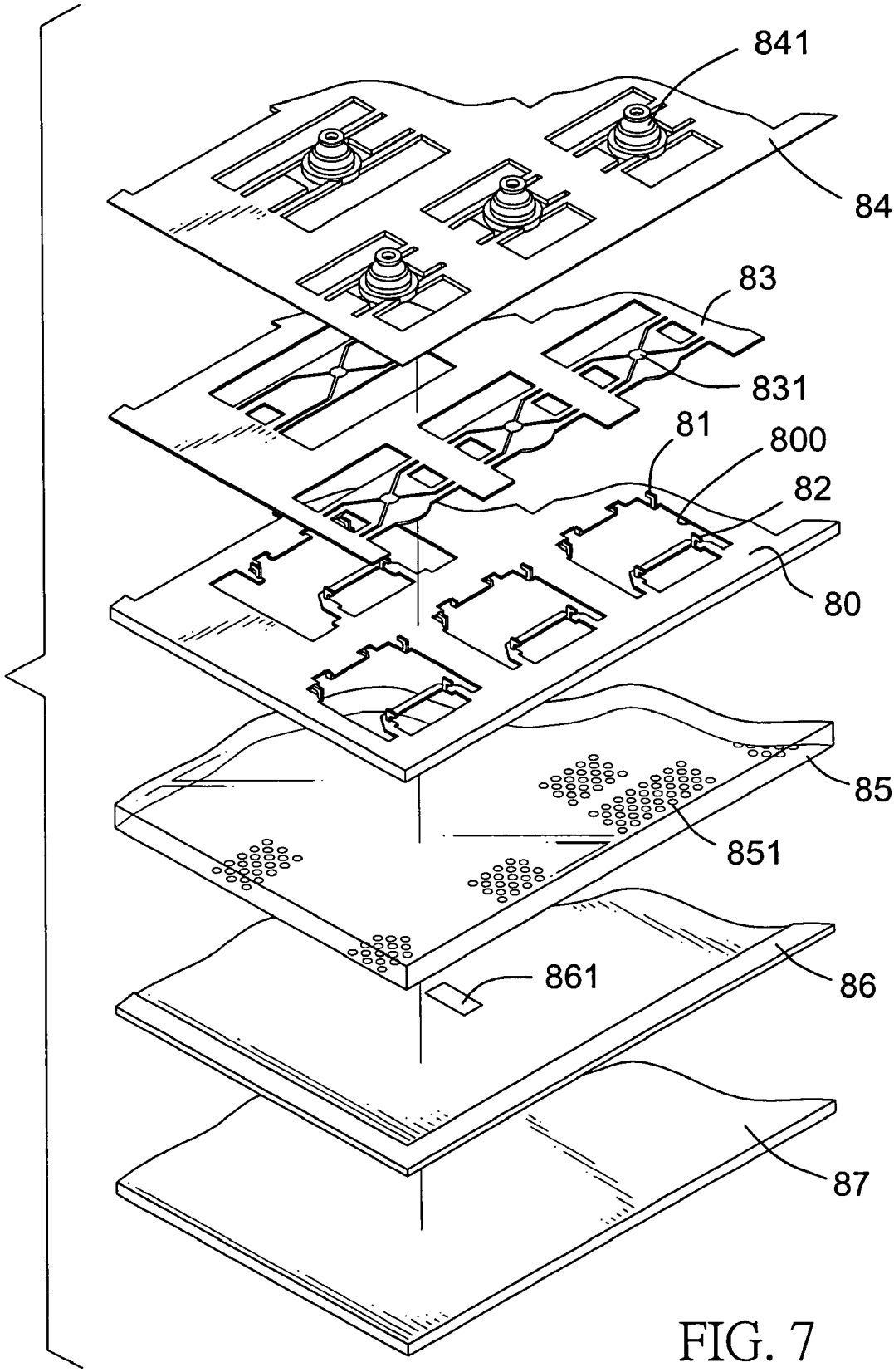
FIG. 7 PRIOR ART
FIG. 7 is an exploded perspective view showing the conventional keyboard assembly.

With reference to FIG. 6, it is noted that there is provided with two pairs of LEDs (63B) (four LEDs) on top of the circuit board (61B) and two light tubes (64B) each connected to one pair of LEDs (63B). Each LED (63B) is provided with an encapsulation (62B) enclosing therein the corresponding LED (63B).

If the provided two LEDs are far away from each other, two circuit boards may be employed to respectively have one of the two LEDs to enhance the illumination effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an illuminating keyboard having an assembly board, a thin film circuit board securely mounted on top of the assembly board, a plastic plate mounted on top of the thin film circuit board for positioning thereon keys, a base securely attached to a bottom of the assembly board and a light enhancing plate securely attached to a bottom face of the base, wherein the improvement comprises:

an illumination device mounted between the assembly board and the base and has at least one light tube with two ends, at least two light emitting diodes each connected to a corresponding one of the two ends of the at least one light tube and at least one circuit board with the at least two light emitting diodes mounted thereon such that light from the at least two light emitting diodes is emitted through the assembly board, the thin film circuit board and the plastic plate to light the keys.

2. The illuminating keyboard as claimed in claim 1, wherein each of the two ends of the at least one light tube is connected to the corresponding one of the at least two light emitting diodes via an encapsulation enclosing therein one of the at least two light emitting diodes.

3. The illuminating keyboard as claimed in claim 2, wherein multiple positioning elements are formed on a bottom face of the assembly board for holding the at least one light tube in position.

4. The illuminating keyboard as claimed in claim 3, wherein each of the positioning elements is composed of a pair of L shaped hooks extendable downward from the assembly board for holding the at least one light tube in position.

5. The illuminating keyboard as claimed in claim 4, wherein there are two light tubes and two light emitting diodes respectively corresponding to one of the two light tubes.

6. The illuminating keyboard as claimed in claim 3, wherein there are two light tubes and two light emitting diodes respectively corresponding to one of the two light tubes.

7. The illuminating keyboard as claimed in claim 2, wherein multiple positioning elements are formed on a top face of the base for holding the at least one light tube in position, each of the positioning elements is composed of a pair of positioning ledges mutually facing each other and each of the positioning ledges having an arcuate cutout defined in a side face thereof such that combination of the two arcuate cutouts of the two positioning ledges defines a receiving space for receiving therein the at least one light tube.

8. The illuminating keyboard as claimed in claim 7, wherein there are two light tubes and two light emitting diodes respectively corresponding to one of the two light tubes.

9. The illuminating keyboard as claimed in claim 2, wherein there are two light tubes and two light emitting diodes respectively corresponding to one of the two light tubes.

10. The illuminating keyboard as claimed in claim 1, wherein there are two light tubes and two light emitting diodes respectively corresponding to one of the two light tubes.

* * * * *